US006574263B1

(12) United States Patent
Iida et al.

(10) Patent No.: US 6,574,263 B1
(45) Date of Patent: Jun. 3, 2003

(54) METHOD FOR CHARGING ANODE INTO FURNACE AND METHOD FOR DESIGNING FURNACE

(75) Inventors: Osamu Iida, Kitasoma-gun (JP); Fumito Tanaka, Saitama (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/198,367

(22) Filed: Jul. 19, 2002

(30) Foreign Application Priority Data

Feb. 8, 2002 (JP) ..... 2002-033006

(51) Int. Cl.[7] ..... F27D 1/00; F27D 3/00

(52) U.S. Cl. ..... 373/71; 373/79

(58) Field of Search ..... 373/71, 72, 79, 373/81, 85, 87, 42, 51, 94, 97; 266/183, 200, 216, 900, 901; 75/646, 652, 686; 414/173, 198, 804; 205/60

(56) References Cited

U.S. PATENT DOCUMENTS 4,274,785 A * 6/1981 Ogawa et al. ..... 266/183
4,581,063 A * 4/1986 Oyabu et al. ..... 266/200
5,685,892 A * 11/1997 Ikoma et al. ..... 266/216

FOREIGN PATENT DOCUMENTS

JP 11-001727 1/1999

* cited by examiner

*Primary Examiner*—Tu Ba Hoang
(74) *Attorney, Agent, or Firm*—Oblon, Spivak, McClelland, Maier & Neustadt, P.C.

(57) ABSTRACT

A method, for charging anode(s) into a furnace, comprises bending anode(s) having a roughly rectangular plate shape at the end of the charging direction, and charging the anode(s) into a melt stored in the furnace through a slope. When the depth of melt is taken to be D (cm), the height of the slope is taken to be H (cm), the inclination angle of the slope is taken to be β (°) and the thickness of the anode is taken to be b (cm), the bending angle α (°) of the anode and the length c (cm) of the bent end of the anode are set to satisfy the following relationship:

Equation (1): $D>A\times(c \sin \alpha/b)^{B}+0.06(H-190)$, provided that A and B are given by:

Equation (2): $A=-1051(\sin \beta)^2+2028 \sin \beta-839.3$, and Equation (3): $B=7.378(\sin \beta)^2-11.64 \sin \beta+3.806$.

8 Claims, 10 Drawing Sheets

METHOD FOR CHARGING ANODE INTO FURNACE AND METHOD FOR DESIGNING FURNACE

BACKGROUND OF THE INVENTION

1. Field of the Invention

The present invention relates to a method for charging anode(s) into a furnace in smelting processes for copper concentrates, and relates to a method for designing a furnace.

2. Description of the Related Art

An example of a known conventional smelting process (Mitsubishi continuous copper smelting and converting process (Mitsubishi process)) for copper concentrates consists of performing smelting treatment continuously by connecting a smelting furnace (S furnace), a slag cleaning furnace (CL furnace) and a converting furnace (C furnace) by means of launders. In this process, copper concentrates are melted in the smelting furnace to form a matte having as its main components copper sulfide and iron sulfide, and a slag having as its main components fluxes, iron oxide, gangue of raw materials, and so forth. Next, the matte and slag are separated in the slag cleaning furnace, and then crude copper is produced by oxidizing the matte in the converting furnace. The crude copper (melt) obtained in this manner is then put in an anode furnace where oxidation and reduction are caused to occur to improve the grade of the copper. Moreover, this melt is then cast into anodes which have approximately rectangular parallelopiped shapes, and the anodes are inserted into electrolytic cells where electrolytic refining is carried out to produce electrolytic copper.

When electrolytic refining is carried out, the anodes dissolve in the electrolyte, and the thickness of the anodes gradually decreases, resulting in a thin plate shape. In this case, since there is a risk that the anodes may be fall into the electrolytic cells if they become excessively thin, electrolytic refining is terminated and the anodes are recovered when they have reached a certain thickness. Each thin plate shaped anode obtained at this time (to be referred to as a "spent anode", weight: 50–110 kg) is returned to the copper smelting process and is again melted in the furnace. When the spent anode is charged into the furnace, the spent anode is preferably charged into the converting furnace which has surplus heat since heat for melting the spent anode is required. However, if the spent anode is charged directly into the converting furnace, the spent anode may impact the furnace bottom, resulting in a risk of damage to the furnace bottom. In contrast, as disclosed in U.S. Pat. No. 5,685,892, a method is proposed in which the spent anode is charged into the converting furnace after slightly bending the anode at the end of the charging direction. According to this method, the spent anode can be charged into the converting furnace without the risk of damage.

However, some anodes used in the electrolytic refining are taken out of the electrolytic cell before completely finishing the electrolytic refining, and they are thicker and heavier than the above-mentioned spent anodes (to be referred to as spent anodes in the broad sense). With respect to these spent anodes in the broad sense and anodes for which the weight and shape during casting are not standard (to be referred to as "reject anodes"), there is the problem of being unable to avoid these anodes colliding with the furnace bottom of the converting furnace simply by bending their ends and charging directly into the converting furnace as described above.

Although these anodes having a weight of 110 kg or more have been charged into the anode furnace, since the heat of the anode furnace is inadequate, a large amount of heat is required to melt these anodes. Consequently, a large amount of fuel is required to heat the anode furnace, which ends up resulting in the problem of high cost. In addition, since it is necessary to change the furnace in which the anodes are charged according to the weight of the anodes, there was also the problem of a large work burden.

SUMMARY OF THE INVENTION

In consideration of the above circumstances, objects of the present invention are to provide a method for charging anode(s) into a furnace, and to provide a method for designing a furnace that allows even the above spent anodes in the broad sense and reject anodes to be charged into the furnace without damaging the furnace bottom.

A first aspect according to the present invention for solving the above problems is characterized by providing a method for charging anode(s) comprising: bending anode(s) having a roughly rectangular plate shape at the end of its charging direction, and charging the anode into a melt stored in a furnace through a slope; wherein, when the depth of the melt is taken to be D (cm), the height of the slope is taken to be H (cm), the inclination angle of the slope is taken to be $\beta$ (°) and the thickness of the anode is taken to be b (cm), the bending angle $\alpha$ (°) of the anode and the length c (cm) of the bent end of the anode are set to satisfy the following relationship:

Equation (1): $D > A \times (c \sin \alpha / b)^B + 0.06(H-190)$; provided that A and B are given by:

Equation (2): $A = -1051(\sin \beta)^2 + 2028 \sin \beta - 839.3$, and

Equation (3): $B = 7.378(\sin \beta)^2 - 11.64 \sin \beta + 3.806$.

When composed in the manner described above, by calculating the bending angle $\alpha$ of the anode and length c of the bent end according to the above equations (1) through (3), collision of the anode charged into the furnace with the furnace bottom can be prevented. Thus, there is no risk of the furnace bottom being damaged by the charging of anode(s). In addition, since the above equations (1) through (3) can not only be applied to the above-mentioned spent anodes (weight: 50–110 kg), but also to spent anodes in the broad sense and to reject anodes (weight: 110 kg or more) that are heavier than the spent anodes, it is no longer necessary to change the type of furnace in which the anodes are charged according to the weight of the anodes, thereby making it possible to simplify the process.

A second aspect according to the present invention is characterized in that the furnace in which the anodes are charged is the converting furnace. That is, when the anode furnace is used for melting the charged anodes, a large amount of heat for heating and melting the anode in the anode furnace is required. On the other hand, when using the converting furnace, since exothermic reactions take place in the furnace and generating surplus heat, fuel for heating and melting the charged anode is not required. As a result, since all of the heat required for heating and melting the anode is provided by the surplus heat of the converting furnace, the thermal balance of the process can be significantly improved. In addition, since the anode can function as a coolant which maintains the converting furnace at the proper temperature, the coolant which is conventionally used is no longer required. Thus, in addition to being able to reduce costs considerably, energy efficiency can also be improved.

A third aspect according to the present invention is characterized in that the inclination angle of the slope is 50–70°. When composed in this manner, whether or not the anode will collide with the furnace bottom can be determined with extremely high accuracy from the above-mentioned equations (1) through (3).

A fourth aspect according to the present invention is characterized in that the anode is charged by an anode charging apparatus equipped with an opening provided on the ceiling or wall of a converting furnace in the smelting process for copper concentrates that connects the inside and outside of the converting furnace, an outer shutter and an inner shutter attached at a distance from the converting furnace in the inside and outside directions of the converting furnace that respectively and independently open and close the opening, and a charging mechanism that charges the anode into the opening.

When composed in the above manner, after lowering the anode into the opening with the charging mechanism in the state in which the outer shutter is open and the inner shutter is closed, the anode is temporarily stopped by engaging with a receiving mechanism arranged between both shutters. Next, the anode is charged into the converting furnace by opening the inner shutter after closing the outer shutter. Since the anode charging can be carried out with the inside and outside of the converting furnace isolated, the converting furnace can be stable thermally without heat loss and gas emission. In addition, the height H of the slope can be adjusted to the optimum value by adjusting the position of the receiving mechanism, thereby being able to effectively prevent the anode from colliding with the furnace bottom.

A fifth aspect according to the present invention is characterized by a method for designing furnace which has a slope for charging anode(s) having roughly a rectangular shape, and its end is bent, into a melt stored in the furnace; wherein, when the bending angle of the anode is taken to be $\alpha$ (°),the length of the bent end of the anode is taken to be c (cm), the thickness of the anode is taken to be b (cm) and the inclination angle of the slope is taken to be $\beta$ (°), the depth D (cm) of the melt and the height H (cm) of the slope are set to satisfy the following relationship:

Equation (1): $D > A \times (c \sin \alpha / b)^B + 0.06(H-190)$; provided that A and B are given by:

Equation (2): $A = -1051(\sin \beta)^2 + 2028 \sin \beta - 839.3$, and

Equation (3): $B = 7.378(\sin \beta)^2 - 11.64 \sin \beta + 3.806$.

When composed in the above manner, the anode charged into the furnace can be prevented from colliding with the furnace bottom by calculating the depth D (cm) of the melt and the height H (cm) of the slope according to the above equations (1) through (3). Thus, there is no risk of the furnace bottom being damaged when the anode is charged thereinto. In addition, since the above equations (1) through (3) can not only be applied to the spent anodes, but also to the spent anodes in the broad sense and to reject anodes, there is no need to change the kind of furnace in which the anodes are charged according to the anode weight, thereby making it possible to simplify the process.

DETAILED DESCRIPTION OF THE PREFERRED EMBODIMENTS

Preferred embodiments of the present invention will be presented in the following with reference to figures.

Figure 1:
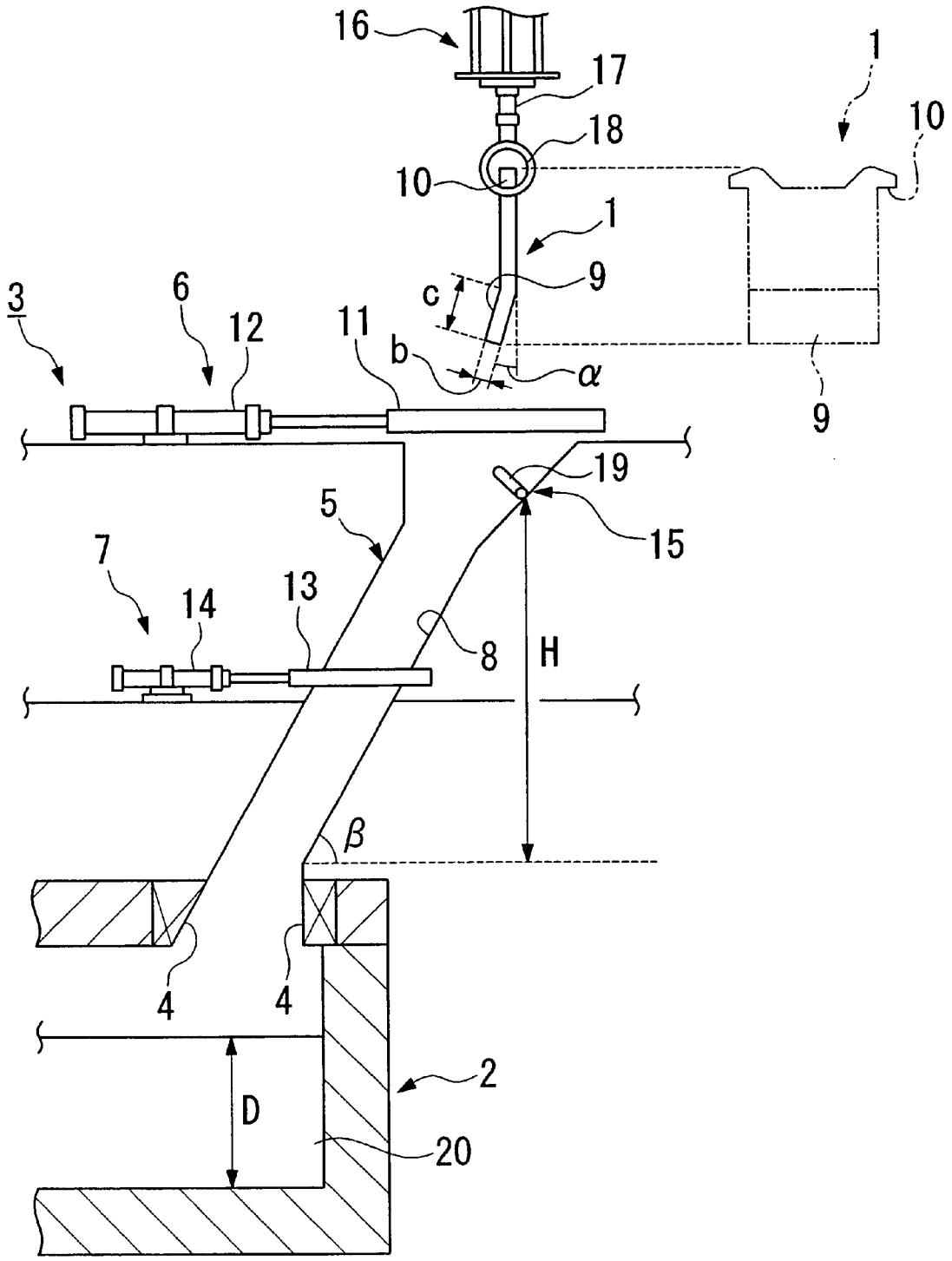
FIG. 1 is a perspective view showing an anode charging apparatus in a mode for carrying out the present invention.

FIG. 1 is a schematic cross-sectional view of a charging apparatus 3 that charges an anode 1 into a converting furnace 2 in a mode for carrying out the present invention. As shown in the drawing, this charging apparatus 3 is equipped with a through hole 4 provided in the ceiling of the converting furnace 2 in the smelting process of copper concentrates, and connects the inside and outside of this converting furnace 2, a roughly square columnar shaped chute 5 fixed to the inside of this through hole 4, an outer shutter 6 and an inner shutter 7 attached to this chute 5 at a distance from the converting furnace in the inside and outside directions of the converting furnace 2 and which are mutually and independently opened and closed, and a transport mechanism (not shown) that transports the anode 1 over the open end of the chute 5. Here, in the apparatus 3, the inside of the chute 5 is in the form of an opening (slope) 8 that connects the inside and outside of the converting furnace 2.

In addition, the anode 1 that is charged by this apparatus 3 is formed into a roughly rectangular thin plate shape, and projections are formed on both shoulders and the lower surfaces of these projections form a pair of engaging portions 10 for improving handling during transfer and electrolytic refining.

Figure 2:
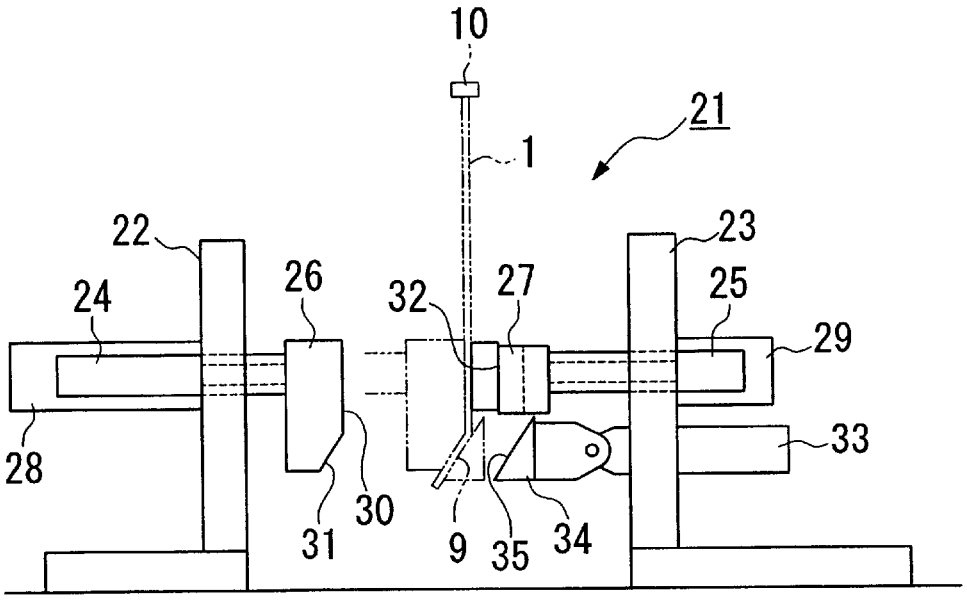
FIG. 2 is a front view showing an anode bending mechanism in a mode for carrying out the present invention.
Figure 3:
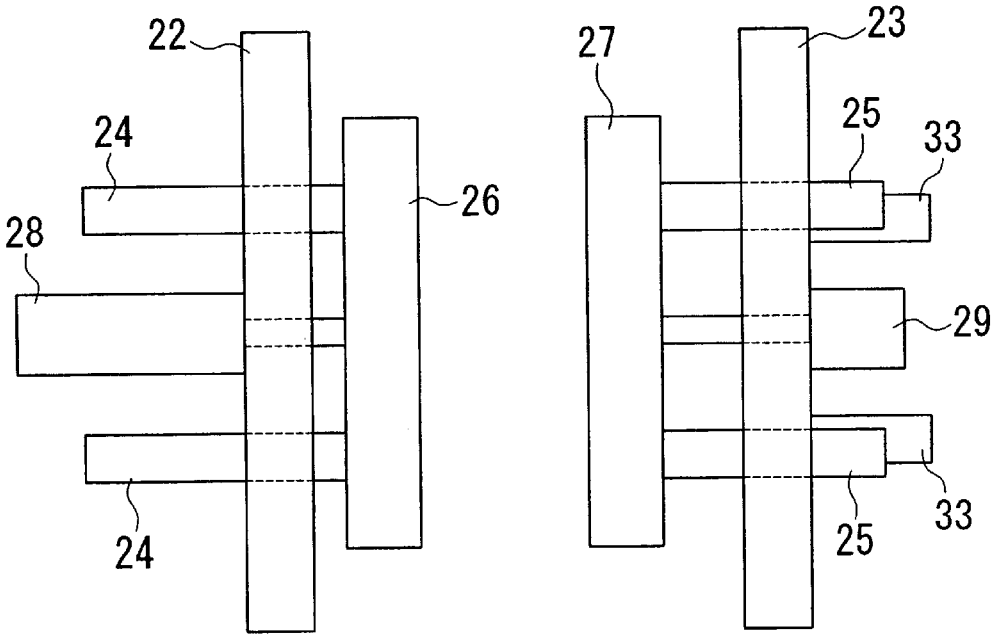
FIG. 3 is an overhead view of the bending mechanism shown in FIG. 2.

The end 9 of this anode 1 is bent by a bending press 21. FIG. 2 is a cross-sectional view of the bending press 21, while FIG. 3 is an overhead view of the bending press 21.

The bending press 21 is equipped with a first frame 22 and second frame 23, a first holding member 26 and second holding member 27 that are supported by the first frame 22 and second frame 23 by a first pair of guide members 24 and second pair of guide members 25, and a first hydraulic cylinder 28 and second hydraulic cylinder 29 that are respectively attached to the first holding member 26 and second holding member 27 and which mutually work in concert to move the first and second holding members closer to each other or away from each other. The first holding member 26 has a vertical surface 30 formed on top and a pressing surface in which an inclined surface 31 is arranged on the bottom, while the second holding member 27 has a pressing surface 32 that is vertical and only opposes the vertical surface of the first holding member. A pair of bending members 34 are arranged below this second holding member 27 that are guided by the second frame 23 and operated by a hydraulic cylinder 33 supported by the second frame 23. Each bending member 34 has an inclined surface 35 that coincides with the inclined surface 31 of the first holding member 26. Due to the operation of first holding member 26 and second holding member 27, the anode 1 is clamped between them and as a result of the operation of the bending members 34, the lower end (tip end) 10 of the anode 1 is pressed against the inclined surface 31 of the first holding member 26 by the bending members 34, and the lower end 10 of the anode 1 is bent at a prescribed angle $\alpha$ and length c. A detailed description thereof is provided later.

The outer shutter 6 is composed of a plate-shaped shutter body 11 that closes the upper end of the chute 5, and an air cylinder 12 that moves this shutter body 11 forward and backward in the horizontal direction.

Similar to this, the inner shutter 7 is composed of a shutter body 13 that closes the chute 5 at a roughly intermediate position in the vertical direction of the chute 5, and an air cylinder 14 that operates it.

In addition, a receiving mechanism 15, which temporarily stops the anode 1 that has been charged into the chute 5 between the shutter body 11 and shutter body 13, installed in the chute 5. This receiving mechanism 15 is equipped with two rod-shaped projections 19 arranged in parallel that are separated at an interval slightly narrower than the interval between engaging portions 10 formed on the shoulders of the anode 1, and which engage with the engaging portions 10 of the anode 1 after having been charged into the chute 5.

In addition, in the apparatus 3, the anode 1 is charged by using a loading mechanism 16 for loading and charging the anode 1 into the chute 5. The loading mechanism 16 is equipped with two raising and lowering cylinders 17 with the rods facing upward, and a chuck 18 provided on the lower ends of the rods of these raising and lowering cylinders 17 that clamps the anode 1.

The converting furnace 2 has roughly cylindrical or rectangular parallelopiped shape and equipped with a hollow portion inside, and melt 20, in which copper material is melted, is stored in this hollow portion.

When the depth of the melt 20 is taken to be D (cm), the height of the opening (slope) 8 of the chute 5 is taken to be H (cm), the inclination angle of the slope 8 is taken to be $\beta$ (°) and the thickness of the anode 1 is taken to be b (cm), the bending angle $\alpha$ (°) of the anode 1 and the length c (cm) of the bent end 9 of the anode 1 are set so as to satisfy the relationship: Equation (1): $D>A\times(c \sin \alpha/b)^B+0.06(H-190)$, provided that A and B are given by: Equation (2): $A=-1051(\sin \beta)^2+2028 \sin \beta-839.3$, and Equation (3): $B=7.378(\sin \beta)^2-11.64 \sin \beta+3.806$.

The following provides an explanation of the method for charging the anode 1 into the converting furnace 2. First, the anode 1 clamped by the chuck 18 of the loading mechanism 16 is positioned above the chute 5 by a transport mechanism which is not shown. Next, the air cylinder 12 of the outer shutter 6 contracts to move the shutter body 11 and open the upper end of the chute 5. Next, after the raising and lowering cylinders 17 extend to lower the anode 1, the chuck 18 opens and the anode 1 is placed on the floor of the chute 5. When this happens, the engaging portions 10 formed on both shoulders of the anode 1 engage with the projections 19 equipped on the receiving mechanism 15 and the anode 1 temporarily stops in the chute 5. As a result, the damage of the inner shutter 7 caused by the lower end of anode 1 can be prevented.

Next, after the air cylinder 12 extends to close the upper end of the chute 5 with the shutter body 11, the air cylinder 14 of the inner shutter 7 contracts and the shutter body 13 retracts from the inside of the chute 5. The projections 19 of the receiving mechanism 15 then move from the engaging position with the anode 1 by a movement means (not shown). As a result, the engagement between the projections 19 and the anode 1 is canceled and the anode 1 drops down. In this manner, the anode 1 can be charged inside the converting furnace 2 by passing through the chute 5.

In this case, since the lower end 10 of the anode 1 is bent at a prescribed angle $\alpha$ and length c, when charging the anode 1 into a converting furnace through the chute 5, damage to the furnace bottom of the converting furnace 2 is prevented by avoiding collision of the anode 1 with the furnace bottom. In addition, even if the anode 1 is charged into the converting furnace 2, there is hardly any disturbance in the heat balance inside the furnace 2, and a detrimental effect caused by the charging of the anode 1 on the smelting process can be prevented. That is, the anode 1 composed of high-purity copper can be charged into the converting furnace 2 and be reused, and can be utilized as a coolant of the converting furnace 2 having surplus heat, thereby making it possible to improve energy efficiency.

As has been described above, since bending angle $\alpha$ of the anode 1 and length c of its end portions 10 are calculated according to the previously mentioned equations (1) through (3), as will be described hereinafter in detail, the anode 1 can be prevented from colliding with the furnace bottom due to the efficient generation of rotational force in the anode 1 that has penetrated in the melt 20 of the converting furnace 2. Thus, there is no risk of the furnace bottom being damaged by the charging of anode 1. In addition, since the above equations (1) through (3) can not only be applied to the spent anodes (weight: 50–110 kg), but also to the spent anodes in the broad sense and to reject anodes (weight: 110 kg or more) that are heavier than this spent anode, it is not necessary to change the type of furnace in which the anode 1 is charged according to its weight, thereby making it possible to simplify the process. Here, the reject anodes include a kind of anode in which finning or warping has occurred during casting or anodes which are substandard due to the level of impurities and weight, as well as those anodes which have not reached the final electrolysis stage. A detailed description of the calculation process of equations (1) through (3) is provided below.

In the converting furnace 2, since an exothermic reaction occurs inside the furnace resulting in a surplus of heat, it is not necessary to heat the anode 1 to melt it. In addition, since the anode 1 is also able to function as a coolant that maintains the converting furnace 2 at the proper temperature, the need for a coolant used in the prior art can be eliminated. More specifically, a quantity of heat of 180 Mcal per ton of the anode 1 is required to re-melt the anode 1. In addition, the combined amount of the spent anodes and reject anodes is normally about 18% of the amount of anodes produced. For this reason, in a converting furnace having an annual anode production of 300,000 tons, a quantity of heat of about 9700 Gcal is required per year to re-melt the spent anodes and reject anodes, for example. If the above quantity of heat is provided by the heat of combustion of heavy oil as in the prior art, it means that combustion of about 2000 $m^3$ of heavy oil is required because about 50% of the net calorific value of heavy oil can be utilized for the above re-melting. In contrast, in the above described embodiment of the present invention, the surplus heat of the converting furnace provides the entire quantity of heat required for the above re-melting, and thus, the heat balance of the process is improved considerably. Accordingly, production costs are reduced and energy efficiency is improved by carrying out the present invention.

Furthermore, although the above described embodiment of the present invention explains the case of charging the anode 1 into the converting furnace 2 installed in the Mitsubishi process, the present invention is not limited to the converting furnace, and a flash converting furnace can also be used. In addition, although it is preferable that the anode 1 be charged into the converting furnace 2, the present invention is not limited to this, and the anode 1 can also be charged into a conventional converter or anode furnace. In addition, the anode 1 is not limited to a spent anode (weight: 50–110 kg), and it may also be a heavier spent anode in the broad sense (weight: 110 kg or more) or a reject anode for which the weight and shape during casting is substandard. In addition, although it is preferable that the apparatus 3 for charging the anode 1 is equipped with the above-mentioned outer shutter 6 and inner shutter 7, this apparatus is not limited to this, and an apparatus which is designed so as to satisfy the above-mentioned equations (1) through (3) can also be used.

In addition, the inclination angle of the slope 8 is preferably 50–70°. In this case, discrimination as to whether or not the anode 1 will collide with the furnace bottom can be performed at an extremely high level of accuracy from the above equations (1) through (3).

In addition, in the above described embodiment of the present invention, although the explanation has been provided in the case of calculating the bending angle $\alpha$ and bending length c of the anode 1 by using the depth D of the melt 20, the height H and inclination angle $\beta$ of the slope 8 and the thickness b of the anode 1 as constants, the height H of the slope 8 and the depth D of the melt 20 can be adjusted by using bending angle $\alpha$ and bending length c of the anode 1 as constants. In addition, in the case in which apparatus 3 is an existing apparatus, the height H of slope 8 can be adjusted by adjusting the position of the receiving mechanism 15.

EXAMPLES

The inventors of the present invention performed experiments using a model for calculating the conditions under which anodes would collide with the furnace bottom. The following provides an explanation of that process using FIGS. 4 through 14.

In order to fabricate an anode model 40 and charging apparatus model 42 that are physically similar to an actual anode 1 and charging apparatus 3, it is necessary to preliminarily examine the conditions for similarity of the movement between the actual anode 1 and anode model 40. However, the force to which the anode is mainly subjected differs between the time until the anode 1 reaches the melt surface and after it has penetrated in the melt 20. Therefore, the models were later integrated by organizing them individually and determining conditions for similarity.

First, the conditions for similarity were determined between the actual anode 1 and anode model 40 in the process until the anode 1 reaches the melt surface. Inertial force and gravity act on the anode 1 as it drops through the gas zone. If a representative length of the anode 1 is taken to be L, then gravity Fg is expressed as equation (4) and inertial force Fi is expressed as equation (5). Here, ps represents the density of the anode 1, v represents velocity, and g represents gravitational acceleration.

Equation (4): $Fg=ps\times g\times L^3$

Equation (5): $FL=ps\times L^2\times v^2$

In order to make the anode model 40 physically similar to the actual anode 1, Fg/FL should be equal for both. Namely, equation (6) represents the condition for similarity when the parameters of the anode model 40 are indicated with primes (')

Equation (6): $Fg/FL=g\times L/v^2=g\times L'/v'^2$

Here, if the energy conservation law in the form of equation (7) is applied by assuming the scale of the anode model 40 to be 1/k times and the falling distance to be h, then equation (8) is obtained for the condition for similarity.

Equation (7): $m\times v^2/2=m\times g\times h$

Equation (8): $1/k=L'/L=h'/h$

For this reason, the anode model 40 having a scale of 1/k times should be dropped from a height of 1/k times the height of the actual anode 1.

Figure 4A:
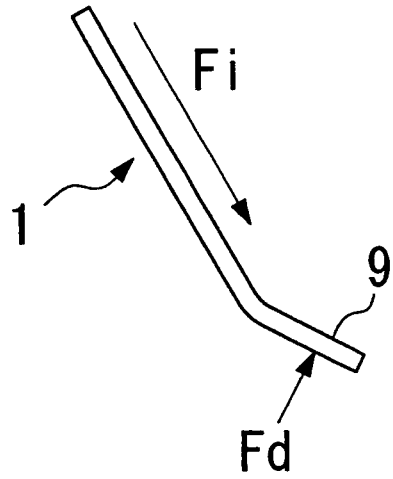
FIG. 4A is an explanatory drawing showing the force with which anodes moving in a molten copper are received.

Next, the conditions for similarity after the anode 1 has penetrated in the melt 20 are determined. As shown in FIG. 4A, inertial force Fi and drag force Fd mainly act on the anode 1 after having penetrated in the melt 20. Since densities of the crude copper and anode 1 are nearly equal, it is unnecessary to consider gravity and buoyancy.

Inertial force Fi and drag force Fd are represented by equations (9) and (10), respectively.

Equation (9): $Fi=ps\times L\times b\times v^2$

Equation (10): $Fd=pL\times c\times L\times V^2\times \sin\alpha$

Figure 4B:
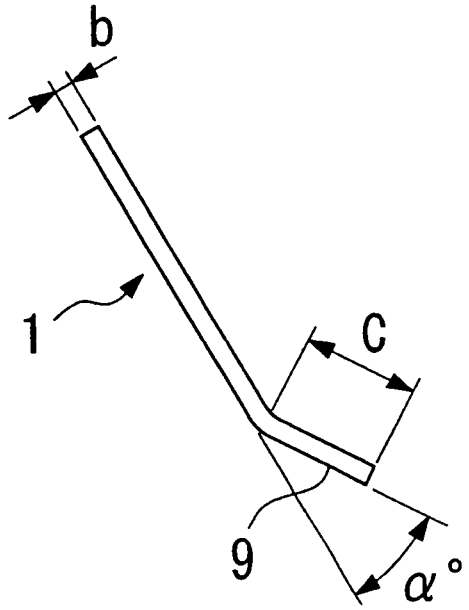
FIG. 4B is an explanatory drawing showing an example of the anodes.
Figure 5:
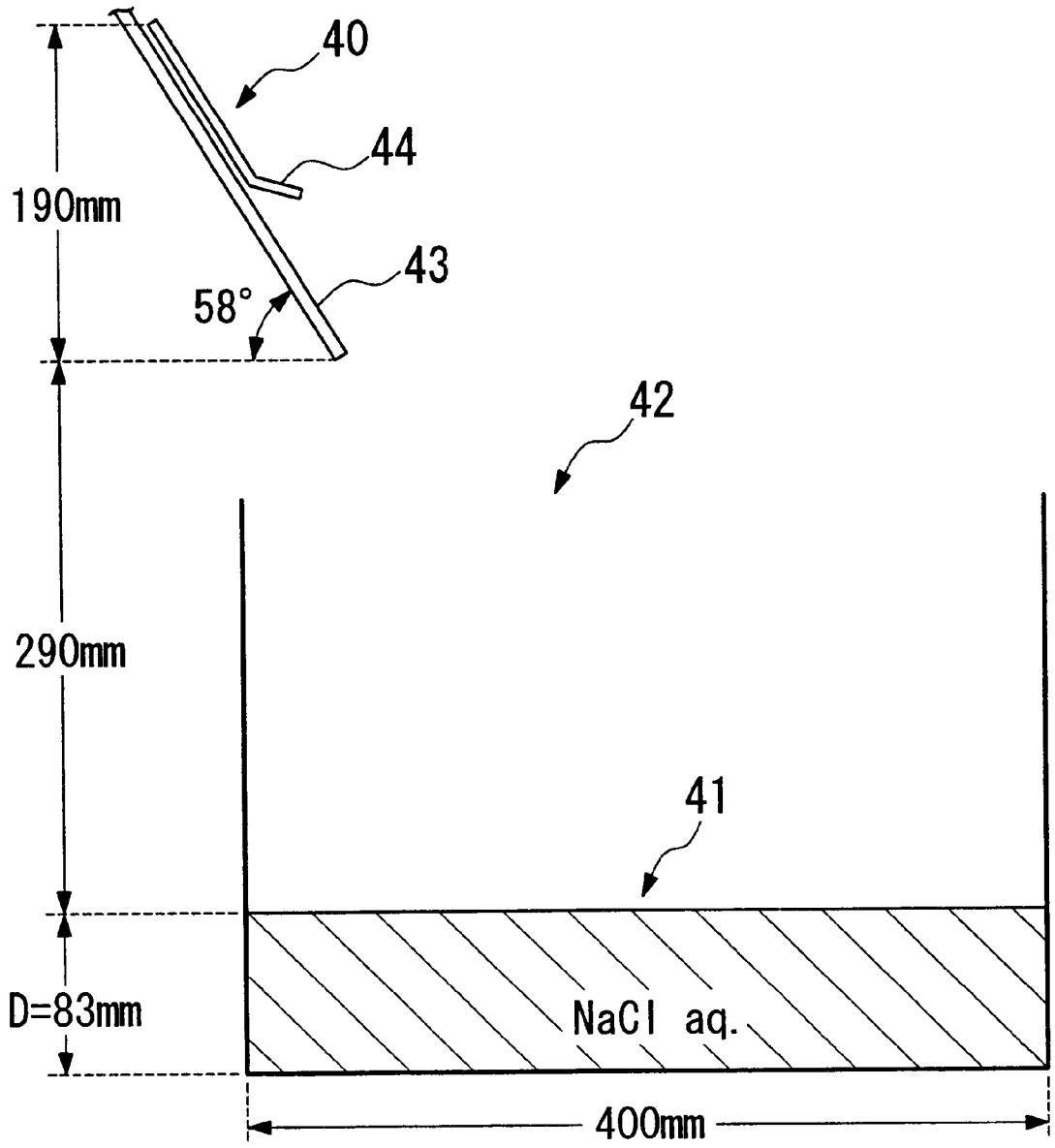
FIG. 5 is a schematic cross-sectional view showing an experimental apparatus for obtaining the conditions under which anodes collide with a furnace bottom and the penetration depth of anodes.

Here, pL represents the density of the crude copper, b the thickness of the anode 1, $\alpha$ the bending angle, and as shown in FIG. 4B, c the distance from the lower end of the anode 1 to the location of the bend. The reason for defining the dimensions of b and c separate from L is so that they can be varied in the experiment.

Fd/Fi should be equal for both in order to make the charging apparatus model 42 that is dynamically similar to the actual charging apparatus 3. Moreover, since the densities of the crude copper and anode 1 are nearly equal (pL=ps), the conditions for similarity are relaxed if the densities of a simulated bath 41 and the anode model 40 are made to be equal. As a result, equation (11) is obtained for the conditions for similarity.

Equation (11): $Fd/Fi=(c\times\sin\alpha)/b=(c'\times\sin\alpha')/b'$

In addition, if the thickness of the anode model 40 is taken to be 1/K times that of the actual anode 1, then equation (12) is obtained.

Equation (12): $1/K=b'/b=(c'\times\sin\alpha')/(c\times\sin\alpha)$

Thus, in the case of fabricating the anode model 40 by taking the bending angle to be $\alpha=\alpha'$, then the bending position should be determined at the same scale factor as the thickness. In other words, the overall apparatus, including the melt depth, should be reduced in size at the same ratio.

The following provides a summary of the above discussion. The anode model 40 fabricated at a scale of 1/k times should be dropped from a height of 1/k times that of the actual anode 1. The anode model 40 fabricated at a scale of 1/K times moves similarly to the actual anode 1 in a bath in which density is equal to the model. For this reason, the anode model 40 should be fabricated by making the densities of the simulated bath 41 and anode model 40 equal, and fabricating the entire apparatus at the same scale of 1/k=1/K.

The anode model 40 and apparatus model 42 were fabricated at a scale of 1/10 of the actual anode 1 and charging apparatus 3. The melt depth of the apparatus model 42 are determined in proportion to the melt depth at the estimated drop point on the actual melt surface (approx. 83 cm), while the length of the slope 43 is determined in proportion to the length of the lower part of the anode hanging hook 18 of the actual charging apparatus 3. In addition, the inclination (inclination angle) of the slope 43 was tested at 58°, which is equal to that of the actual slope 8, and at 50° and 70°.

The anode model 40 was fabricated from acrylic resin (density: approx. 1.18 g/cm$^3$), and a saline solution which has a density equal to that of the acrylic resin was used for the simulated bath (melt) 41. However, the density of the saline solution was adjusted to 1.15 g/cm$^3$ to be slightly lower than that of the acrylic resin for preventing the floating of the anode model 40 in the bath. The saline solution was contained in a rectangular water tank made of transparent vinyl chloride (400 mm L×250 mm W×300 mm H) (see FIG. 5).

The anode model 40 was provided on the slope 43 so that the bent portion 44 of the lower end thereof was oriented along the inclined direction of the slope 43. This orientation is the same as for the actual apparatus 3. The movement of the anode model 40 after sliding down the slope 43 was recorded at 125 frames/second using a CCD camera. The test was performed at least five times for each model 40, and the average value of the penetration depth was determined from the images. The fluctuation in the penetration depth under identical test conditions was within ±0.5 cm.

The height of the actual gas zone (height from the upper surface of the simulated bath 40 to the lower end of the slope 43) can employ a value equivalent to from 1 time to 5 times the depth D of the melt. According to the results of a preliminary experiment using the apparatus model 42, a difference larger than the experimental error did not occur in the penetration depth of the anode model 40 even when the height of the gas zone was changed between 1×D to 5×D. Therefore, the height of the gas zone in the apparatus model 42 was fixed at 290 mm equivalent to 3.5×D at the experiment described below.

Figure 6:
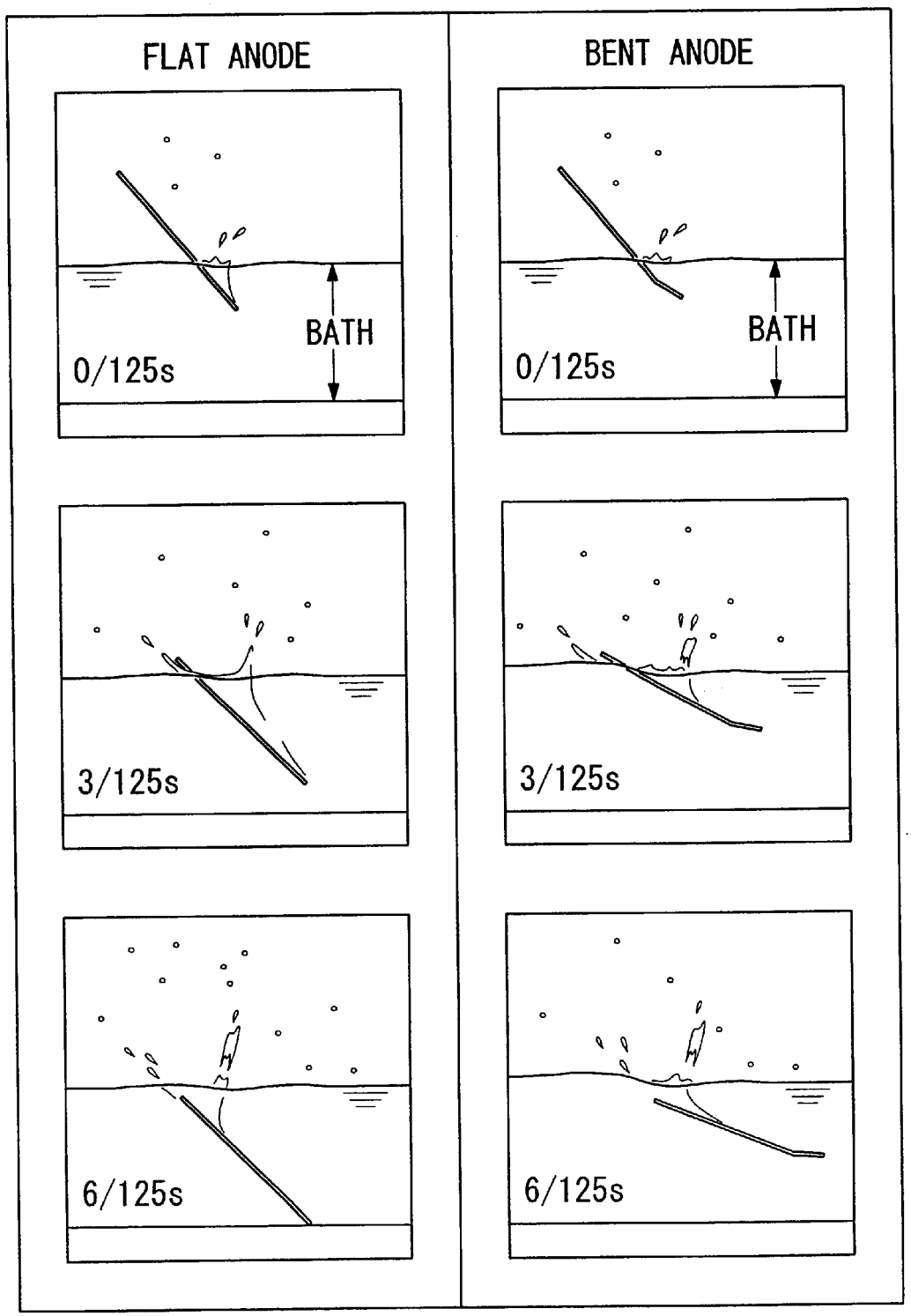
FIG. 6 is an explanatory drawing showing experimental results using the experimental apparatus of FIG. 5.

FIG. 6 shows tracings of a series of photographs of the anode model 40 having a plate thickness of 1 mm as it moves through the bath. The left side of FIG. 6 shows the movement of a flat anode model 45, while the right side shows the movement of the anode model 40 that has been bent at an angle of 30° at a location 16 mm from the lower end. In addition, the times shown in the lower left corner of each image indicate the elapsed time in the case of assuming the time at which the top photograph was taken to be 0. As may be concluded from FIG. 6, when the lower end of the anode model 40 was bent, rotational force to the upward direction was generated in the anode model 40, and collision of the anode model 40 with the tank bottom was avoided.

Figure 7:
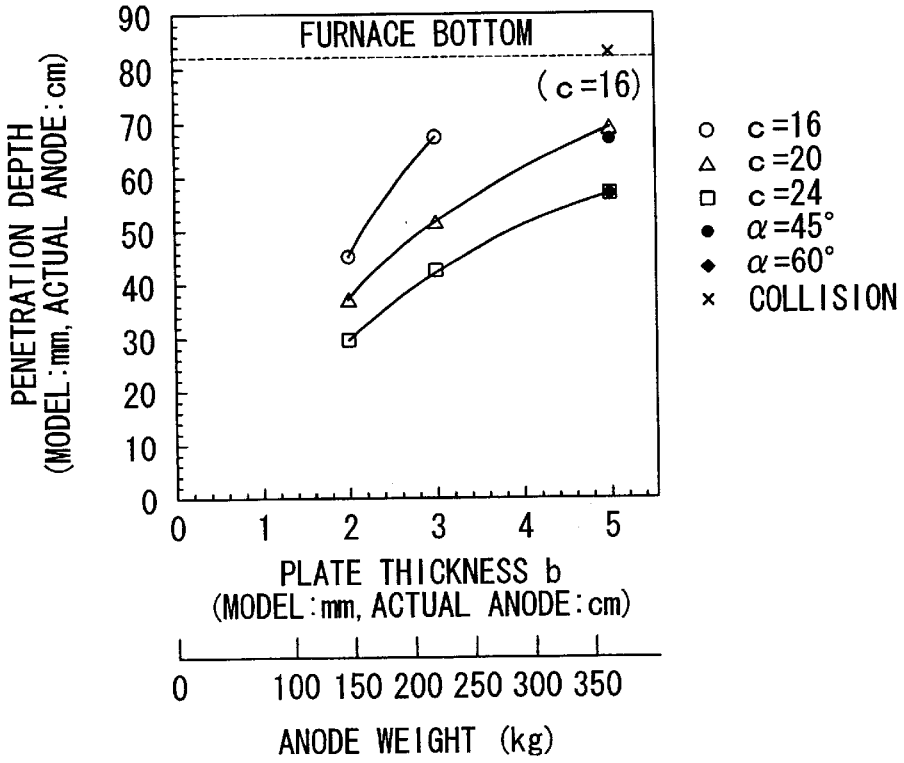
FIG. 7 is a graph showing the relationship among anode thickness, bending angle, bending length and penetration depth for a slope inclination angle of 58°.
Figure 8:
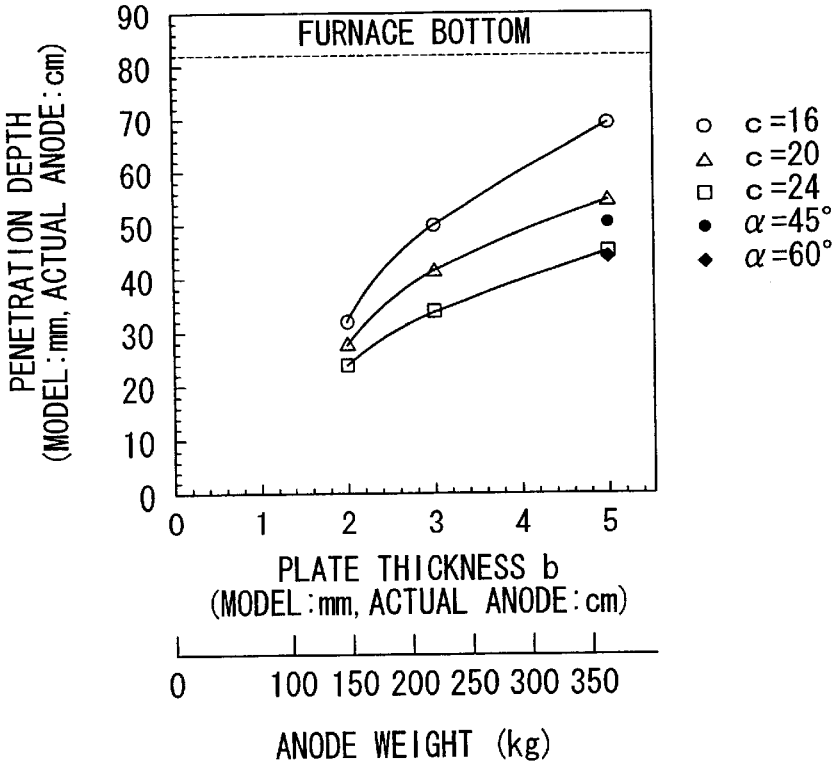
FIG. 8 is a graph showing the relationship among anode thickness, bending angle, bending length and penetration depth for a slope inclination angle of 50°.

The relationship between the penetration depth and variables consisting of thickness b of the anode model 40, distance c from the lower end of the anode model 40 to the location of the bend, and bending angle $\alpha$ was investigated by changing these variables. FIG. 7 shows the results in the case of using a slope 43 of 58° similar to the actual anode 1, while FIG. 8 shows the results in the case of using a slope 43 of 50°0. Furthermore, those examples in which the anode model 40 collided with the bottom are indicated with an x. In addition, the units of b and c and penetration depth of the anode model 40 are indicated in mm. As a result, the values in the actual anode 1 can be obtained simply by converting the units to cm because the anode model 40 was used having a scale of 1/10. Unless indicated otherwise, the value of $\alpha$ is 30°. Moreover, the weight of the actual anode 1 is also shown on the horizontal axes of FIGS. 7 and 8. However, this was determined based on the assumption that the apparent density of the anode 1 is 8.0 g/cm$^3$. These figures show that if c and $\alpha$ are suitably selected, a reject anode (350 kg) resulting during casting can also be handled by a converting furnace (C furnace).

The common characteristics of FIGS. 7 and 8 consist of the three points indicated below. That is, (i) the penetration depth increases as plate thickness p increases, (ii) the penetration depth decreases with increasing distance c from the lower end of the anode model 40 to the location of the bend, and (iii) the penetration depth increases with increasing bending angle $\alpha$.

The point (i) indicates that the penetration depth increases as the inertial force of the anode model 40 increases, while the points (ii) and (iii) indicate that the penetration depth decreases as the drag force of the anode model 40 which is subjected by the bath 41 increases (see Equations (9) and (10)).

On the other hand, a comparison of FIGS. 7 and 8 reveals that each model 40 penetrates deeper as the inclination (inclination angle) of slope 43 increases. The penetration depth increases further when the inclination of slope 43 becomes 70°. The cause of this is that, since the penetration angle relative to the bath surface increases the steeper the inclination of slope 43, the angle at which the anode model 40 must rotate in the bath increases correspondingly. For this reason, it is preferable that the inclination of the slope 43 is lessened to widen the range of the shape (c, $\alpha$) and weight (b) of the anode model 40 that can be treated.

Figure 9:
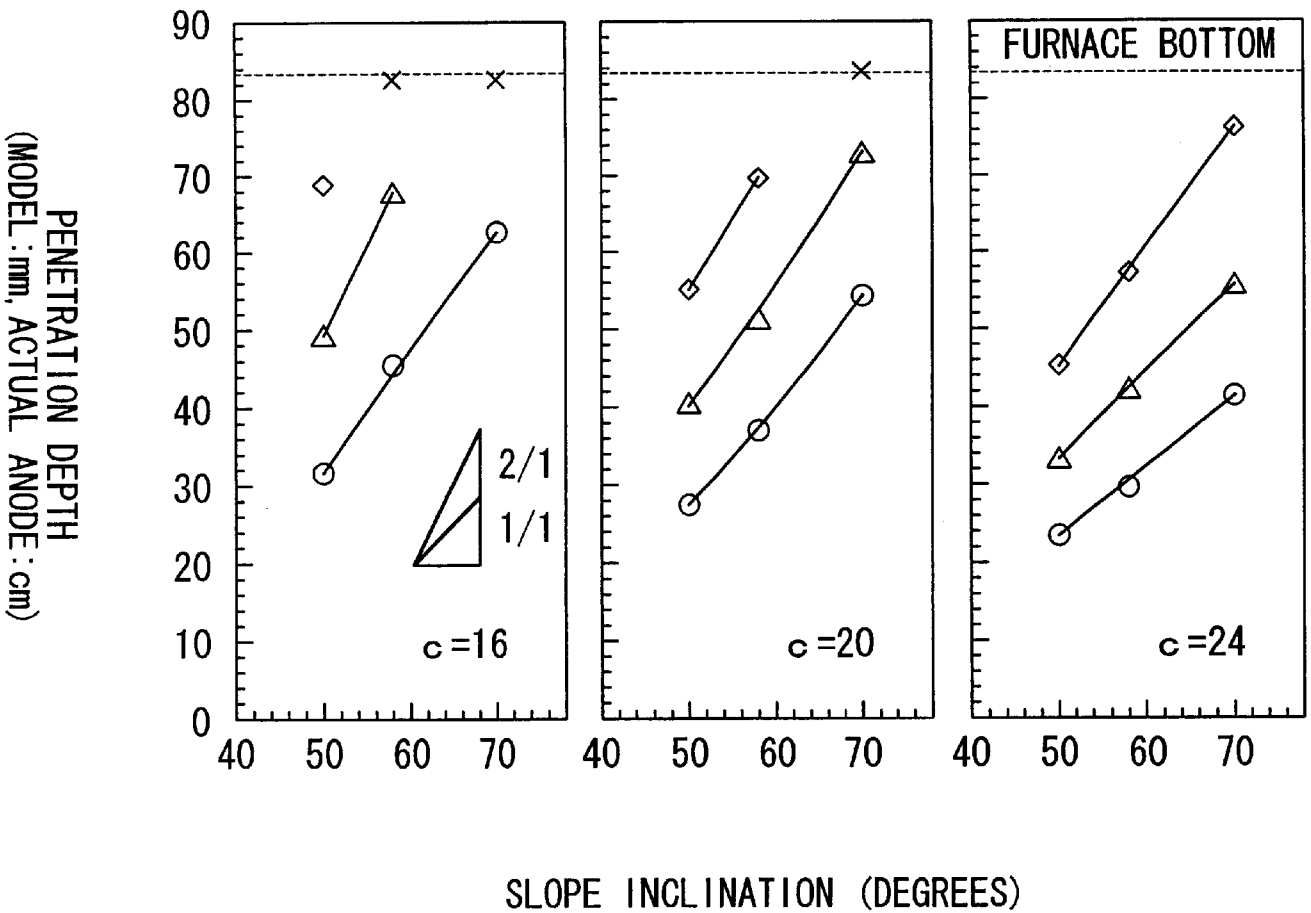
FIG. 9 shows graphs showing the relationship between slope inclination angle and penetration depth.
Figure 10:
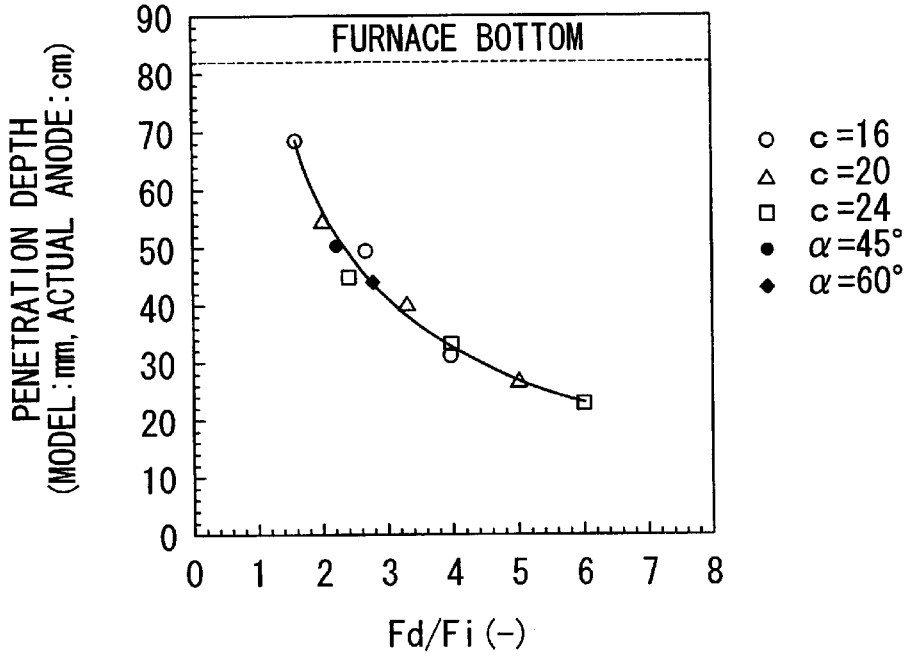
FIG. 10 is a graph showing the relationship between dimensionless value Fd/Fi and penetration depth for a slope inclination angle of 50°.
Figure 11:
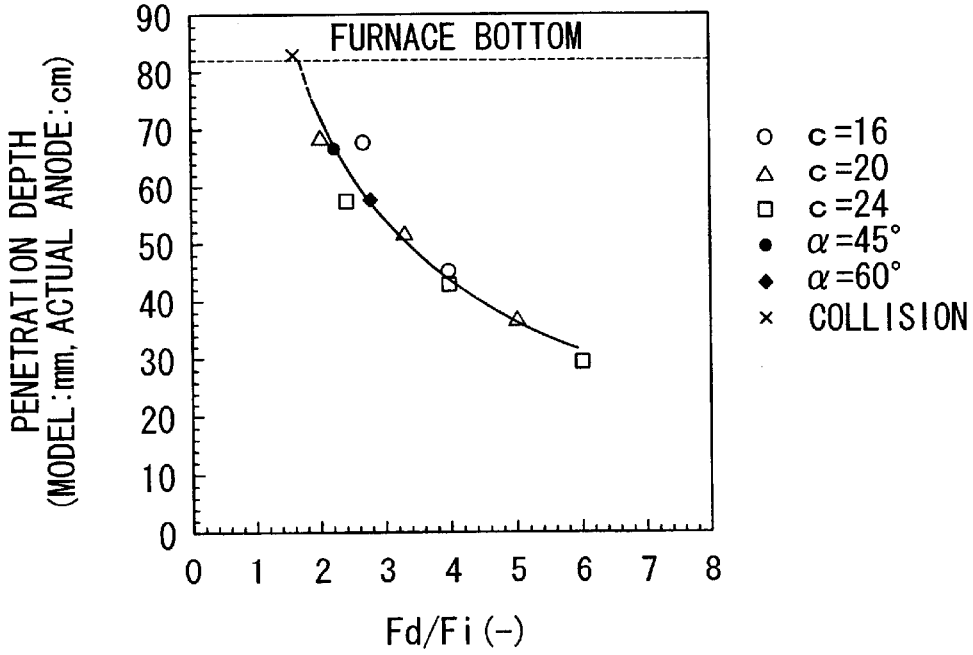
FIG. 11 is a graph showing the relationship between dimensionless value Fd/Fi and penetration depth for a slope inclination angle of 58°.
Figure 12:
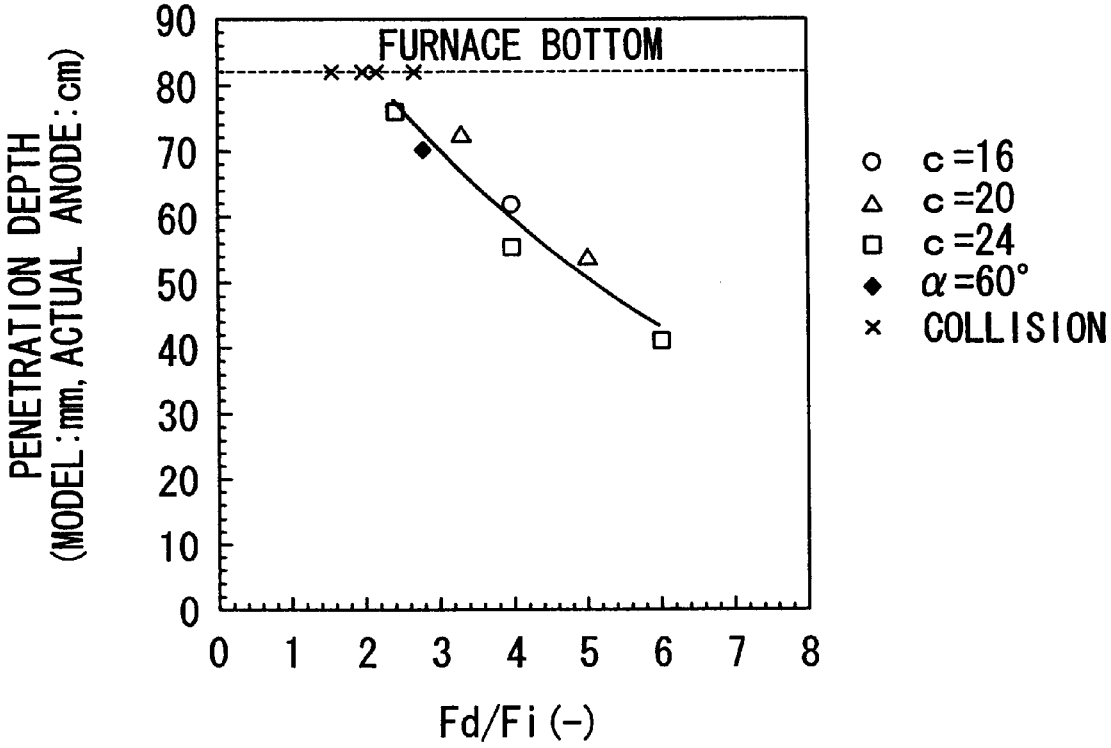
FIG. 12 is a graph showing the relationship between dimensionless value Fd/Fi and penetration depth for a slope inclination angle of 70°.

A summary of the effects of the inclination of the slope 43 on the penetration depth is shown in FIG. 9. The penetration depth becomes more sensitive to the inclination of slope 43 as the penetration depth b increases, and conversely becomes less sensitive as the above-mentioned c and $\alpha$ increase. Furthermore, the gradients of inclinations I and 2 are indicated with triangles in FIG. 9. According to the experimental data, each time the slope 8 in the actual apparatus 3 is lessened by 1°, the penetration depth of the actual anode 1 becomes shallower by 1–2 cm.

A dimension-less number Fd/Fi indicated in Equation (11) is an important parameter that controls the movement of the anode model 40 that has penetrated into the simulated bath 41. That is, as Fd/Fi increases, the penetration depth becomes shallower since the rotational force of the anode model 40 increases. The relationship between the penetration depth and Fd/Fi was organized for each of the cases of inclinations of the slope 43 of 50°, 58°, and 70° to yield the series shown in FIGS. 10, 11, and 12.

These figures show that if the inclination of the slope 43 is assumed to be constant, the penetration depth is determined nearly uniquely by Fd/Fi. In particular, when the inclination of the slope is 50° or 58°, the penetration depth can be estimated with an extremely high degree of accuracy and collision or non-collision with the bottom can be discriminated. On the other hand, in the case in which the inclination of the slope is 70°, variations of the data plotted in the figure become conspicuous, and it becomes somewhat difficult to discriminate between collision and non-collision. Based on the characteristics of the variation in the data, a tendency can be seen in which the anode model 40 penetrates deeper in the simulated bath as the surface which is subjected to the drag force becomes smaller (c is small) due to slow development of the rotational force. In other words, the example of the inclination of 70° indicates the importance of the stable rotational movement of the anode model 40. In view of the above circumstances, a curve plotted on the figure based on the data of the example of the inclination of 70° can also be employed for practical use.

Figure 13:
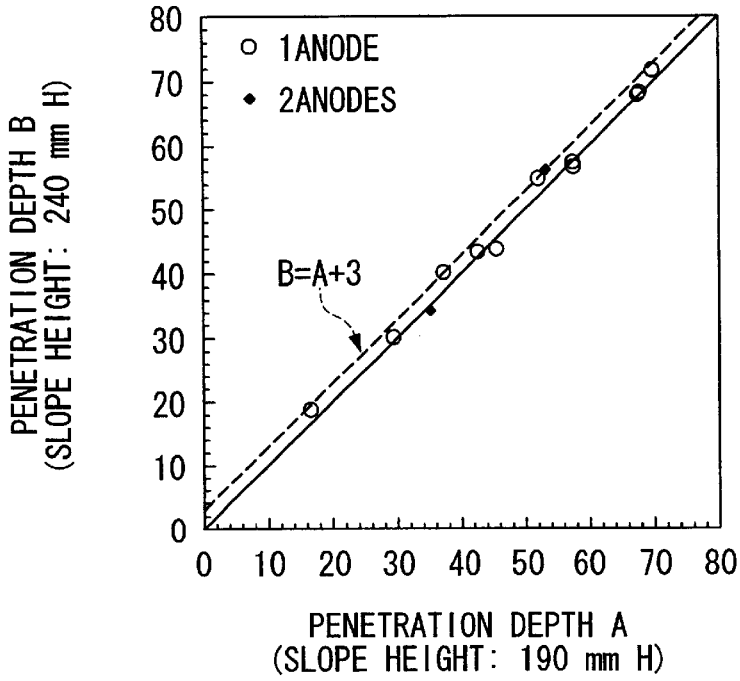
FIG. 13 is a graph showing a comparison of penetration depth according to differences in slope drop.
Figure 14:
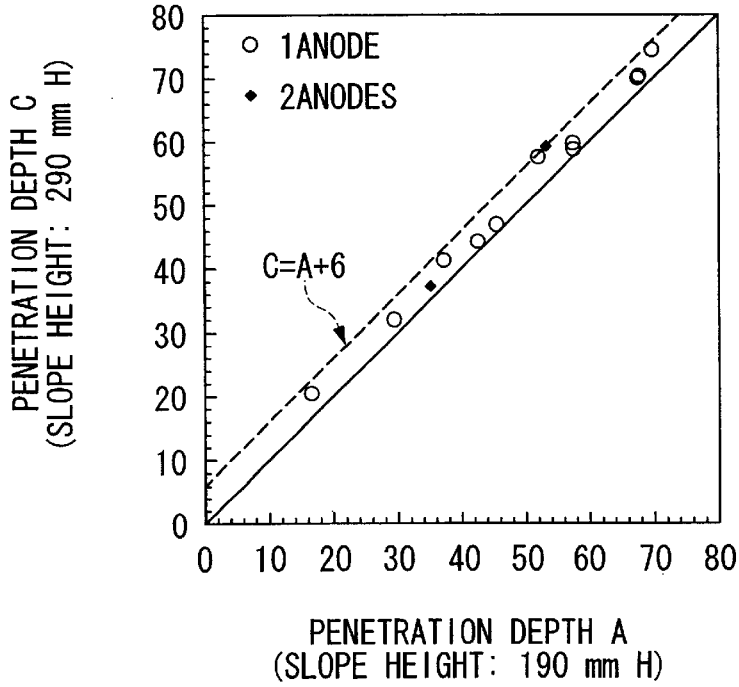
FIG. 14 is a graph showing a comparison of penetration depth according to differences in slope drop.

FIG. 13 shows a comparison of the penetration depth between the case of a slope height of the slope of 190 mm H (baseline value) and the case of a height of the slope 43 of 240 mm H (baseline value +50 mm). FIG. 14 shows a comparison of the penetration depth between the case of the height of the slope 43 of 190 mm (baseline value) and the case of the height of the slope 43 of 290 mm H (baseline value +100 mm). According to these figures, a tendency is observed in which penetration depth increases accompanying an increase in the fall of the slope 43. When the solid lines of these figures are moved in parallel by +3 and +6, respectively, in the direction of the vertical axis followed by drawing the broken lines of B=A+3 and C=A +6, all of the plots on the figures are located below the broken lines. For this reason, if the drop of the slope 8 is increased by 50 cm H or 100 cm H in an actual apparatus, the penetration depth of the anode 1 can be estimated to increase by 3 cm and 6 cm.

In this example, when the bending angle of the anode is taken to be α (°), the length of the bent end portion of the anode is taken to be c (cm), the thickness of the anode is taken to be b (cm), and the inclination angle of the slope is taken to be β (°), then equations (1) through (3) are obtained as relational expressions between the depth D (cm) of the melt and height H (cm) of the slope, as a result of the experiments as have been described above.

What is claimed is:

1. A method for charging anode(s) into a furnace comprising steps of: bending anode(s).having a roughly rectangular plate shape at an end of the charging direction, so that when a depth of said melt is D (cm), a height of said slope is H (cm), an inclination angle of said slope is β (°) and a thickness of said anode is b (cm), a bending angle α (°) of said anode and a length c (cm) of a bent end of said anode are set to satisfy the following relationship:

Equation (1): $D>A\times(c \sin \alpha/b)^{B}+0.06(H-190)$;

provided that A and B are given by:

Equation (2): $A=-1051(\sin \beta)^2+2028 \sin \beta-839.3$, and

Equation (3): $B=7.378(\sin \beta)^2-11.64 \sin \beta+3.806$;/and charging said anode(s) into a melt stored in said furnace through a slope.

2. A method for charging anode(s) into a furnace according to claim 1 wherein, said furnace in which said anode(s) is charged is a converting furnace.

3. A method for charging anode(s) into a furnace according to claim 1 wherein, the inclination angle of said slope is 50–70°.

4. A method for charging anode(s) into a furnace according to claim 2 wherein, the inclination angle of said slope is 50–70°.

5. A method for charging anode(s) into a furnace according to claim 1, wherein said step of charging said anode(s) into said melt is performed by an anode charging apparatus equipped with: an opening provided on the ceiling or wall of a converting furnace, for the smelting process of copper concentrates, that connects the inside and outside of said converting furnace, an outer shutter and an inner shutter attached at a distance from said converting furnace in the inside and outside directions of said converting furnace that respectively and independently open and close said opening, and a charging mechanism that charges spent anodes into said opening.

6. A method for charging anode(s) into a furnace according to claim 2, wherein said step of charging said anode(s) into said melt is performed by an anode charging apparatus equipped with: an opening provided on the ceiling or wall of a converting furnace in the smelting process of copper concentrates that connects the inside and outside of said converting furnace, an outer shutter and an inner shutter attached at a distance from said converting furnace in the inside and outside directions of said converting furnace that respectively and independently open and close said opening, and a charging mechanism that charges spent anodes into said opening.

7. A method for charging anode(s) into a furnace according to claim 3, wherein said step of charging said anode(s) into said melt is performed by an anode charging apparatus equipped with: an opening provided on the ceiling or wall of a converting furnace in the smelting process of copper concentrates that connects the inside and outside of said converting furnace, an outer shutter and an inner shutter attached at a distance from said converting furnace in the inside and outside directions of said converting furnace that respectively and independently open and close said opening, and a charging mechanism that charges spent anodes into said opening.

8. A method for designing a furnace which has a slope for charging, anode(s) having a roughly rectangular shape and a bent end into a melt stored in said furnace comprising a step of bending an end of the anode(s) so that a bending angle of said anode is α (°), a length of a bent end of said anode is c (cm), a thickness of said anode is b (cm) and an inclination angle of said slope is β (°), and a depth D (cm) of said melt and a height H (cm) of said slope are set to satisfy the following relationship:

Equation (1): $D>A\times(c \sin \alpha/b)^{B}+0.06(H-190)$;

provided that A and B are given by:

Equation (2): $A=-1051(\sin \beta)^2+2028 \sin \beta-839.3$, and

Equation (3): $B=7.378(\sin \beta)^2-11.64 \sin \beta+3.806$.

* * * * *